US007247008B2

(12) United States Patent
Clements et al.

(10) Patent No.: US 7,247,008 B2
(45) Date of Patent: Jul. 24, 2007

(54) CAM RING BEARING FOR FUEL DELIVERY SYSTEM

(75) Inventors: Martin A. Clements, North Royalton, OH (US); Robert Nyzen, Chardon, OH (US)

(73) Assignee: Argo-Tech Corporation, Cleveland, OH (US)

( * ) Notice: Subject to any disclaimer, the term of this patent is extended or adjusted under 35 U.S.C. 154(b) by 0 days.

(21) Appl. No.: 10/521,637

(22) PCT Filed: Jul. 21, 2003

(86) PCT No.: PCT/US03/22680

§ 371 (c)(1),
(2), (4) Date: Sep. 19, 2005

(87) PCT Pub. No.: WO2004/009992

PCT Pub. Date: Jan. 29, 2004

(65) Prior Publication Data

US 2006/0099100 A1 May 11, 2006

Related U.S. Application Data

(60) Provisional application No. 60/397,212, filed on Jul. 19, 2002.

(51) Int. Cl.
*F03C 2/00* (2006.01)
*F04C 18/00* (2006.01)

(52) U.S. Cl. ..... 418/30; 418/31; 418/173; 384/308

(58) Field of Classification Search ..... 418/30, 418/31, 152, 153, 173; 384/103, 114, 308, 384/310

See application file for complete search history.

(56) References Cited

U.S. PATENT DOCUMENTS

| | | | | |
|---|---|---|---|---|
| 1,671,240 | A * | 5/1928 | Gurley | 418/173 |
| 2,241,824 | A * | 5/1941 | Meyerhoefer | 418/173 |
| 2,635,551 | A | 4/1953 | DeLancey | |
| 3,143,079 | A | 8/1964 | Carner | |
| 5,518,380 | A * | 5/1996 | Fujii et al. | 418/30 |

FOREIGN PATENT DOCUMENTS

| | | | | |
|---|---|---|---|---|
| GB | 2074247 | | 10/1981 | |
| JP | 59108891 | A * | 6/1984 | 418/173 |
| JP | 59-188077 | | 10/1984 | |
| JP | 02-086982 | | 3/1990 | |

* cited by examiner

*Primary Examiner*—Theresa Trieu
(74) *Attorney, Agent, or Firm*—Fay Sharpe LLP

(57) ABSTRACT

A bearing assembly is provided for a fuel delivery system that includes a pump (10) having a housing that rotatably receives a rotor (20) carrying vanes (26) thereon, a cam ring (70) received between the housing and rotor (20), and a support member of yoke (50) encompassing the cam ring (70) to selectively vary fuel flow. The bearing assembly (80) is a journal bearing between the yoke (50) and the cam ring (70) and includes an annular surface having a central opening therethrough. The annular surface includes a first, high pressure pad (102) and a second, low pressure pad (104) substantially diametrically opposite the first pad and separated by first and second lands (106, 108). The circumferential extent of the first pad (102) is at least as great as an inner diameter of the cam ring (70). Circumferential ends of the second pad (104) are wider than circumferential ends of the first pad. The first and second pads (102, 104) are formed by circumferentially extending grooves that extend an entire width of the bearing so that the cam ring moves between the first and second pads, and thereby varies a clearance between the lands (106, 108) and the cam ring (70).

20 Claims, 6 Drawing Sheets

CAM RING BEARING FOR FUEL DELIVERY SYSTEM

This application claims the benefit of International Application No. PCT/US03/022680, International Filing Date 21 Jul. 2003 and U.S. Provisional Application Ser. No. 60/397,212, filed 19 Jul. 2002.

BACKGROUND OF THE INVENTION

The present invention relates to a bearing arrangement, and more particularly to a bearing arrangement used to support a cam ring within a support member or yoke in a hydrostatic and hydrodynamic configuration for use in fuel pumps, metering, and control for jet engines.

PCT/US02/09298, filed Mar. 27, 2002, the details of which are incorporated herein by reference, relates to a fuel delivery system having increased efficiency and reliability over known fuel pump arrangements. Particularly, a pump of a fuel delivery system includes a housing having a chamber with an inlet and outlet in fluid communication with the pump chamber. A rotor is received in the pump chamber, and a cam member surrounds the rotor and is freely rotatable relative to the housing and the rotor. A journal bearing is formed between the cam ring and a support sleeve or yoke that is precluded from rotation within the housing.

The bearing arrangement must be responsive to hydrostatic and hydrodynamic forces imposed thereon by the internal components of the pumping mechanism. Known bearing arrangements require improvement to properly support the cam ring in a combined hydrostatic and hydrodynamic arrangement. Accordingly, a need exists for a new bearing assembly.

SUMMARY OF THE INVENTION

An improved bearing assembly is provided for a fuel delivery system that includes a housing receiving a rotor within a rotatable cam ring, where the cam ring is freely rotatable relative to the housing and the rotor. The bearing assembly includes an annular surface having a central opening dimensioned to receive the associated cam ring.

The annular surface includes a first, high pressure pad and a second low pressure pad spaced by first and second lands.

The circumferential extension of the first pad is at least as great as an inner diameter of the cam ring.

Circumferential ends of the second pad are preferably wider than the circumferential ends of the first pad.

A differential pressure is established across the pump chamber and the cam ring is capable of movement between the high and low pressure pads in response to pressure variations. Clearance between the land and the cam ring selectively alters the flow of fluid through the bearing to maintain a pressure. This creates a relatively stiff bearing mount without deflection concerns.

A primary advantage of the invention resides in an improved bearing interface between a rotating cam ring and stationary (non-rotatable), but moveable yoke.

Another advantage of the invention resides in the structure being capable of providing hydrostatic bearing capabilities, as well as hydrodynamic bearing capabilities.

Still other benefits and advantages of the invention will become apparent to those skilled in the art upon a reading and understanding of the following detailed description.

DETAILED DESCRIPTION OF THE INVENTION

Figure 1:
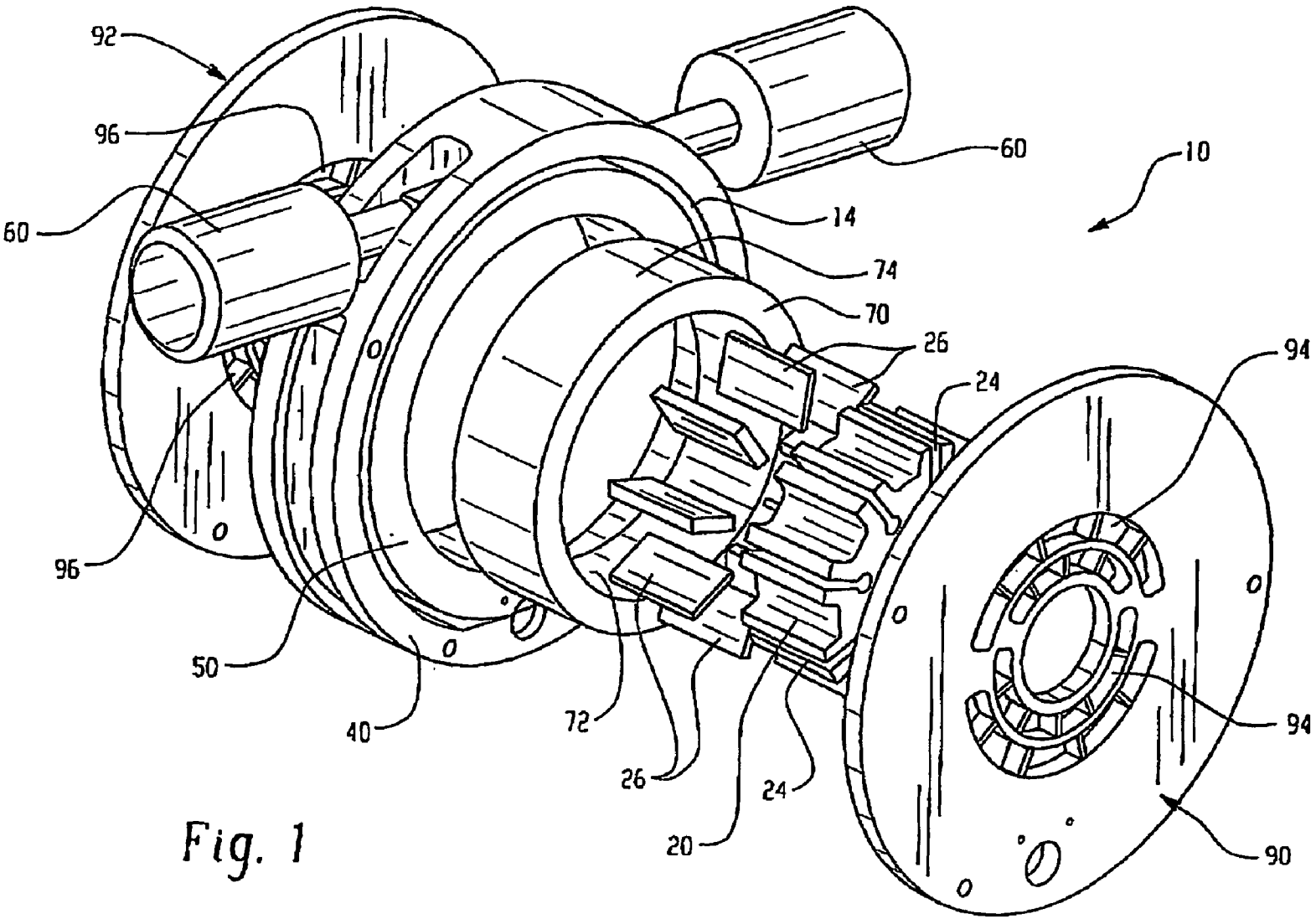
FIG. 1 is an exploded perspective view of a preferred embodiment of the fluid pump.
Figure 2:
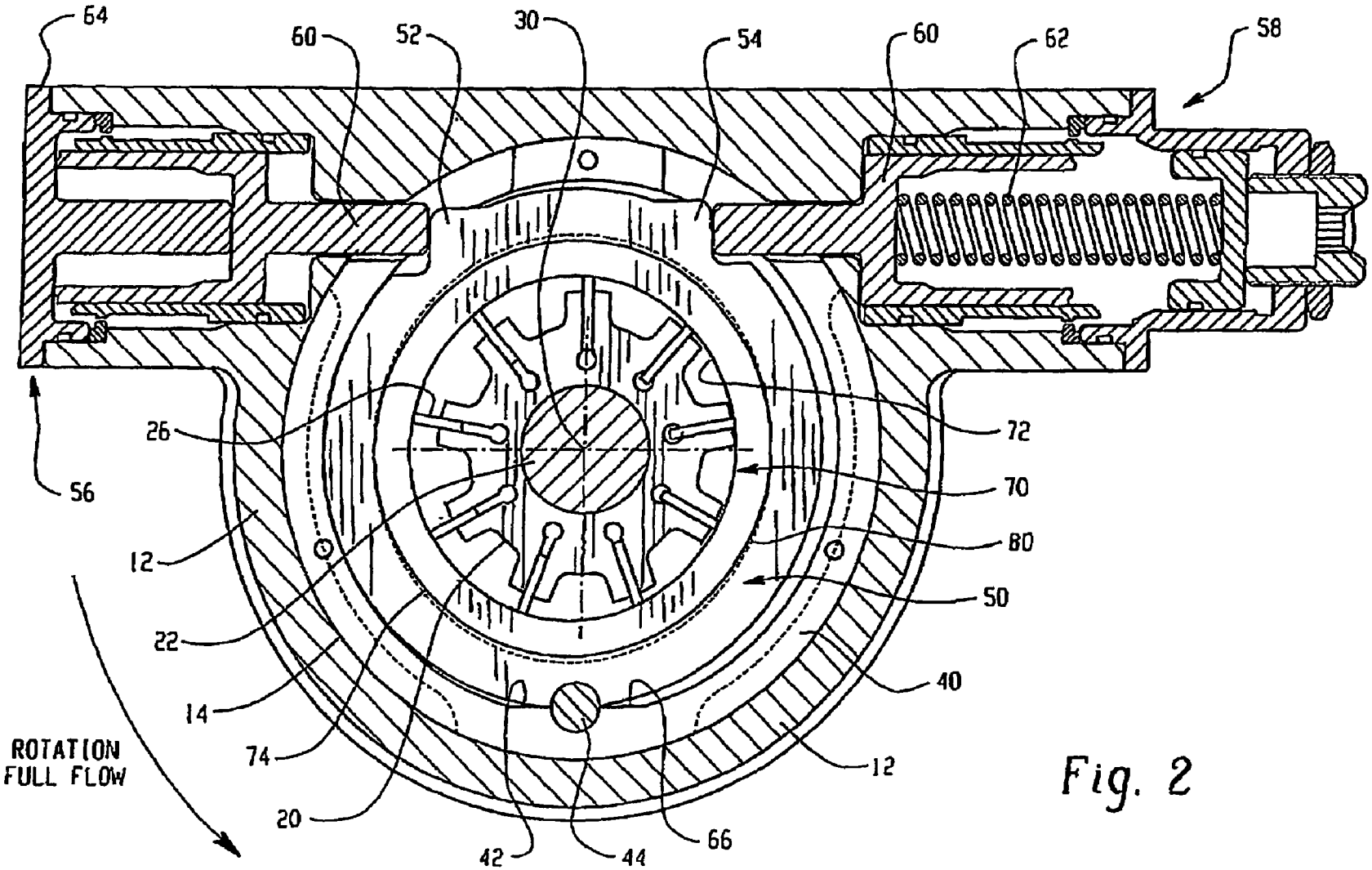
FIG. 2 is a cross-sectional view through the assembled pump of FIG. 1.

As shown in the Figures, a pump assembly 10 includes a housing 12 having a pump chamber 14 defined therein. Rotatably received in the chamber is a rotor 20 secured to a shaft 22 for rotating the rotor within the chamber. Peripherally or circumferentially spaced about the rotor are a series of radially extending grooves 24 that operatively receive blades or vanes 26 having outer radial tips that extend from the periphery of the rotor. The vanes may vary in number, for example, nine (9) vanes are shown in the embodiment of FIG. 2, although a different number of vanes can be used without departing from the scope and intent of the present invention. As is perhaps best illustrated in FIG. 2, the rotational axis of the shaft 22 and rotor 20 is referenced by numeral 30. Selected vanes (right-hand vanes shown in FIG. 2) do not extend outwardly from the periphery of the rotor to as great an extent as the remaining vanes (left-hand vanes in FIG. 2) as the rotor rotates within the housing chamber. Pumping chambers are defined between each of the vanes as the vanes rotate in the pump chamber with the rotor and provide positive displacement of the fluid.

With continued reference to FIG. 2, a spacer ring 40 is rigidly secured in the housing and received around the rotor at a location spaced adjacent the inner wall of the housing chamber. The spacer ring has a flat or planar cam rolling surface 42 and receives an anti-rotation pin 44. The pin pivotally receives a cam sleeve 50 that is non-rotatably received around the rotor. First and second lobes or actuating surfaces 52, 54 are provided on the sleeve, typically at a location opposite the anti-rotation pin. The lobes cooperate with first and second actuator assemblies 56, 58 to define means for altering a position of the cam sleeve 50. The altering means selectively alter the stroke or displacement of the pump in a manner well known in the art. For example, each actuator assembly includes a piston 60, biasing means such as spring 62, and a closure member 64 so that in response to pressure applied to a rear face of the pistons, actuating lobes of the cam sleeve are selectively moved. This selective actuation results in rolling movement of the cam sleeve along a generally planar or flat surface 66 located along an inner surface of the spacer ring adjacent on the pin 44. It is desirable that the cam sleeve undergo a linear translation of the centerpoint, rather than arcuate movement, to limit pressure pulsations that may otherwise arise in seal zones of the assembly. In this manner, the center of the cam sleeve is selectively offset from the rotational axis 30 of the shaft and rotor when one of the actuator assemblies is actuated and moves the cam sleeve (FIG. 2). Other details of the cam sleeve, actuating surface, and actuating assemblies are generally well known to those skilled in the art so that further discussion herein is deemed unnecessary.

Received within the cam sleeve is a rotating cam member or ring 70 having a smooth, inner peripheral wall 72 that is contacted by the outer tips of the individual vanes 26 extending from the rotor. An outer, smooth peripheral wall 74 of the cam ring is configured for free rotation within the cam sleeve 50. More particularly, a journal bearing 80 supports the rotating cam ring 70 within the sleeve. The journal bearing is filled with the pump fluid, here jet fuel, and defines a hydrostatic or hydrodynamic, or a hybrid hydrostatic/hydrodynamic bearing. The frictional forces developed between the outer tips of the vanes and the rotating cam ring 70 result in a cam ring that rotates at approximately the same speed as the rotor, although the cam ring is free to rotate relative to the rotor since there is no structural component interlocking the cam ring for rotation with the rotor. It will be appreciated that the ring rotates slightly less than the speed of the rotor, or even slightly greater than the speed of the rotor, but due to the support/operation in the fluid film bearing, the cam ring possesses a much lower magnitude viscous drag. The low viscous drag of the cam ring substitutes for the high mechanical losses exhibited by known vane pumps that result from the vane frictional losses contacting the surrounding stationary ring. The drag forces resulting from contact of the vanes with the cam ring are converted directly into mechanical losses that reduce the pumps overall efficiency. The cam ring is supported solely by the journal bearing 80 within the cam sleeve. The journal bearing is a continuous passage. That is, there is no interconnecting structural component such as roller bearings, pins, or the like that would adversely impact on the benefits obtained by the low viscous drag of the cam ring. For example, flooded ball bearings would not exhibit the improved efficiencies offered by the journal bearing, particularly a journal bearing that advantageously uses the pump fluid as the fluid bearing.

In prior applications these mechanical drag losses can far exceed the mechanical power to pump the fluid in many operating regimes of the jet engine fuel pump. As a result, there was a required use of materials having higher durability and wear resistance because of the high velocity and load factors in these vane pumps. The material weight and manufacturing costs were substantially greater, and the materials also suffer from high brittleness. The turning speed of those pumps was also limited due to the high vane sliding velocities relative to the cam ring. Even when using special materials such as tungsten carbide, high speed pump operation, e.g., over 12,000 RPM, was extremely difficult.

These mechanical losses resulting from friction between the vane and cam ring are replaced in the present invention with much lower magnitude viscous drag losses. This results from the ability of the cam ring to rotate with the rotor vanes. A relatively low sliding velocity between the cam ring and vanes results, and allows the manufacturer to use less expensive, less brittle materials in the pump. This provides for increased reliability and permits the pump to be operated at much higher speeds without the concern for exceeding tip velocity limits. In turn, higher operating speeds result in smaller displacements required for achieving a given flow. In other words, a smaller, more compact pump can provide similar flow results as a prior larger pump. The pump will also have an extended range of application for various vane pump mechanisms.

Figure 3:
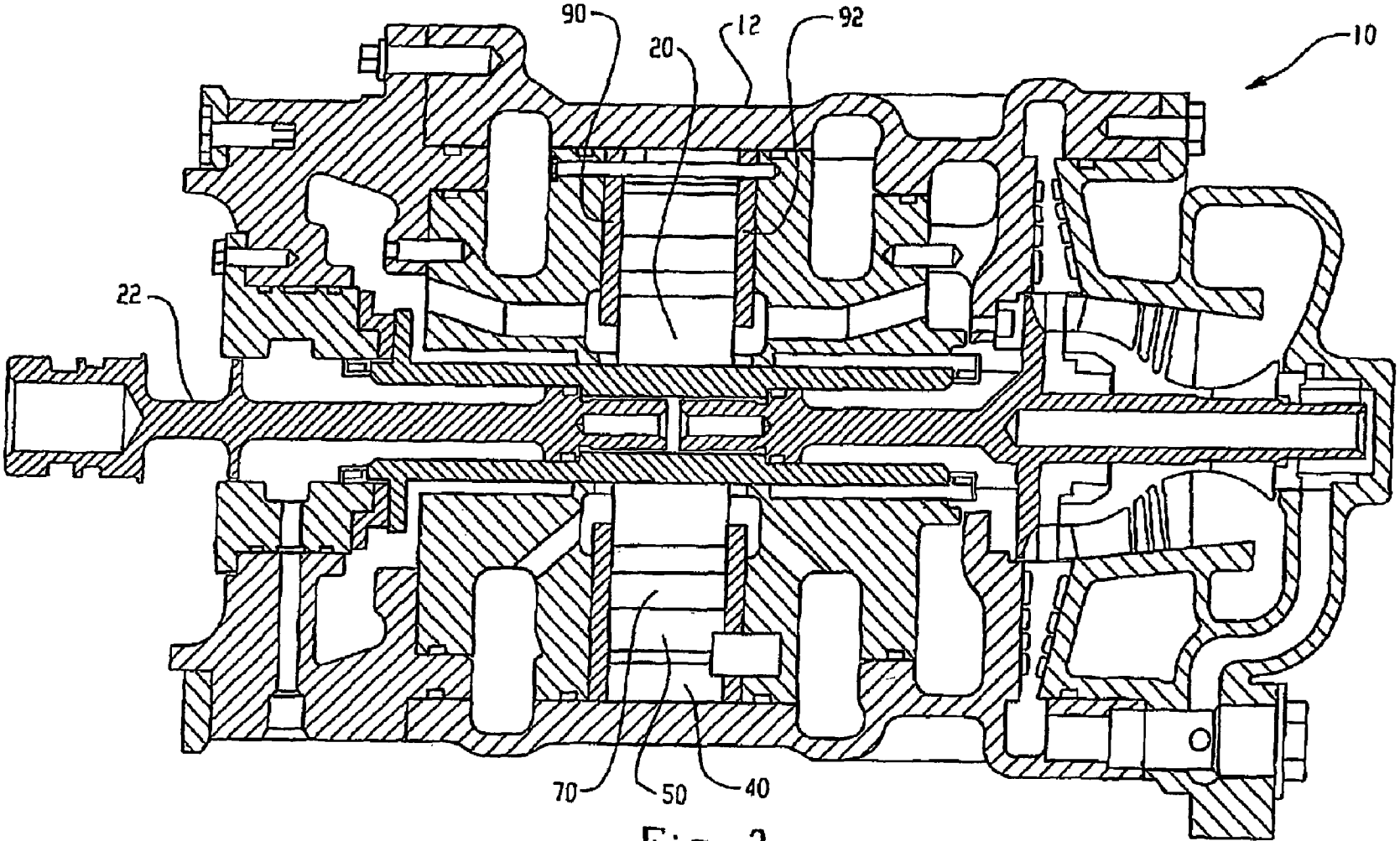
FIG. 3 is a longitudinal cross-sectional view through the assembled pump.

FIG. 3 more particularly illustrates inlet and outlet porting about the rotor for providing an inlet and outlet to the pump chamber. First and second plates 90, 92 have openings 94, 96, respectively. Energy is imparted to the fluid by the rotating vanes. Jet fuel, for example, is pumped to a desired downstream use at an elevated pressure.

Figure 4:
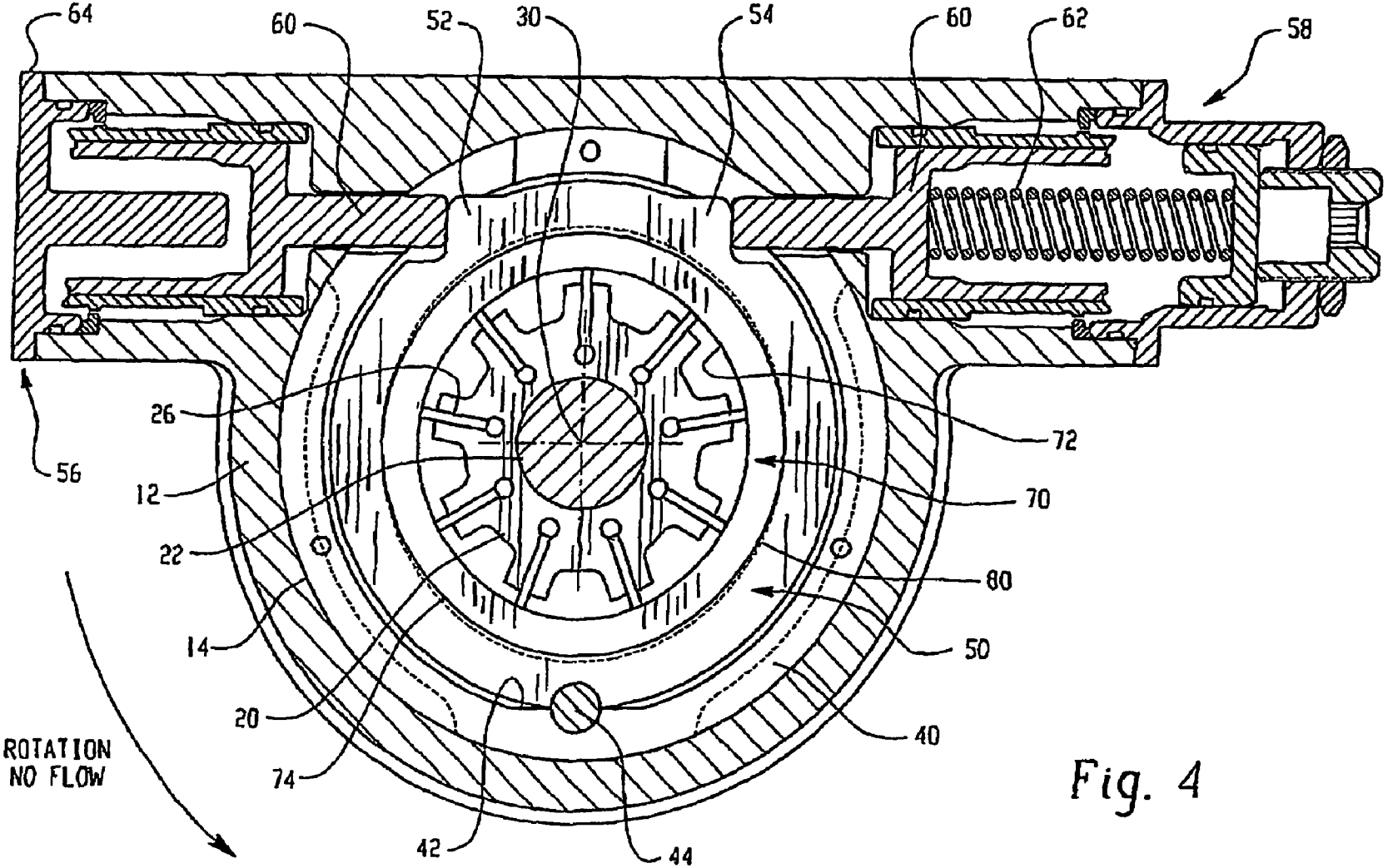
FIG. 4 is a cross-sectional view similar to FIG. 2 illustrating a variable displacement pump with the support ring located in a second position.

As shown in FIG. 4, neither of the actuating assemblies is pressurized so that the cam sleeve is not pivoted to vary the stroke of the vane pump. That is, this no flow position of FIG. 4 can be compared to FIG. 2 where the cam sleeve 50 is pivoted about the pin 44 so that a close clearance is defined between the cam sleeve and the spacer ring 40 along the left-hand quadrants of the pump as illustrated in the Figure. This provides for variable displacement capabilities in a manner achieved by altering the position of the cam sleeve.

In the preferred arrangement, the vanes are still manufactured from a durable, hard material such as tungsten carbide. The cam ring and side plates, though, are alternately formed of a low cost, durable material such as steel to reduce the weight and manufacturing costs, and allow greater reliability. Of course, it will be realized that if desired, all of the components can still be formed of more expensive durable materials such as tungsten carbide and still achieve substantial efficiency benefits over prior arrangements. By using the jet fuel as the fluid that forms the journal bearing, the benefits of tungsten carbide for selected components and steel for other components of the pump assembly are used to advantage. This is to be contrasted with using oil or similar hydraulic fluids as the journal bearing fluid where it would be necessary for all of the jet fuel components to be formed from steel, thus eliminating the opportunity to obtain the benefits offered by using tungsten carbide.

Figure 5:
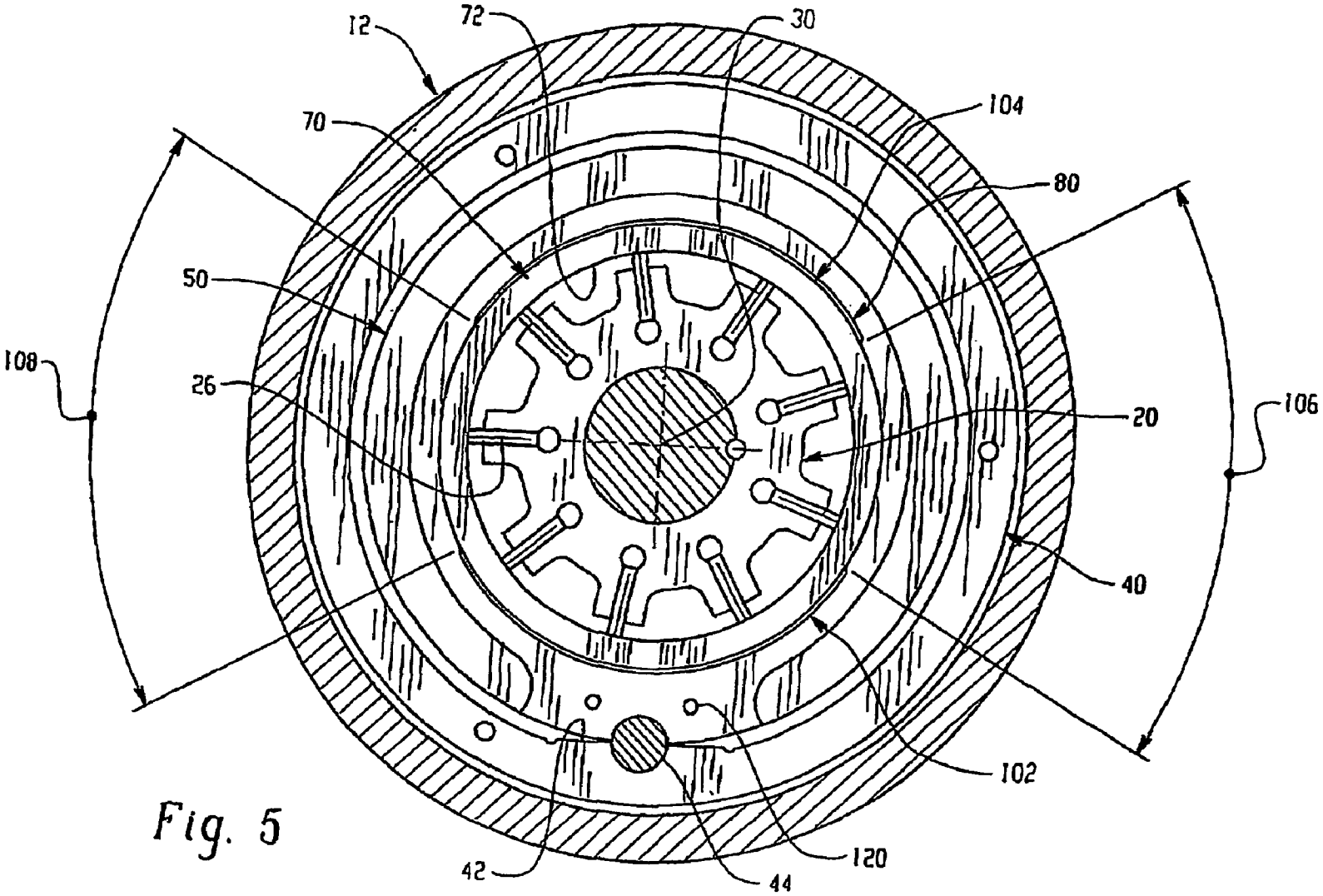
FIG. 5 is an enlarged cross-sectional view of the pump.
Figure 6:
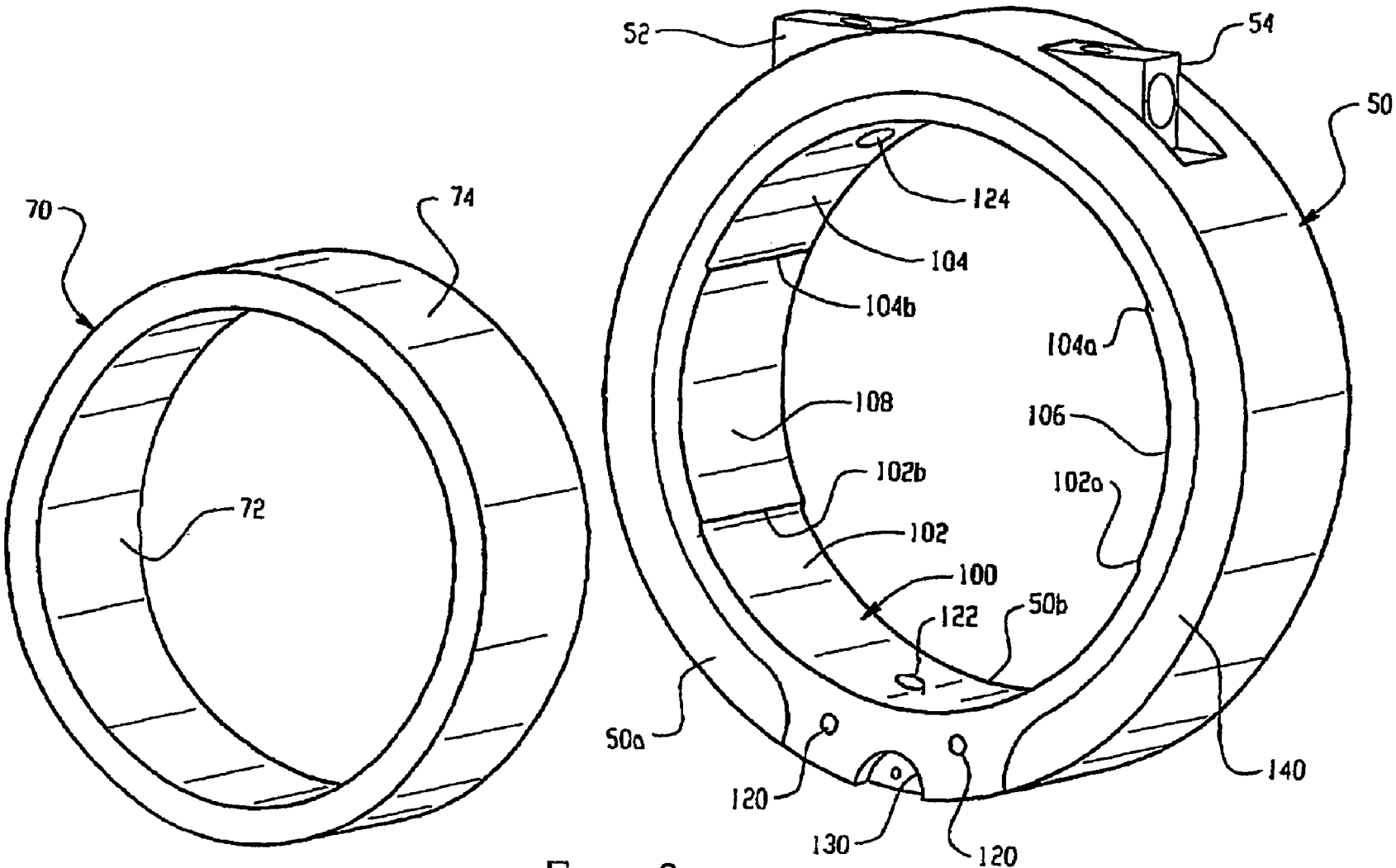
FIG. 6 is an exploded perspective view of the bearing assembly.

As illustrated in greater particularity in FIGS. 5 and 6, the journal bearing assembly defined by the interface between the cam sleeve or yoke 50 and the cam ring 70 is shown in greater detail. Particularly, the inner surface 100 of the support sleeve or yoke is a non-constant diameter to define discrete portions of the bearing arrangement. Specifically, a first or large diameter portion 102 defines a first, high pressure pad and a diametrically opposite, second or low pressure pad 104. For ease of description, and as will be appreciated from FIG. 5, the high pressure pad portion 102 extends from approximately 4 o'clock to 8 o'clock while the low pressure pad extends from approximately 10 o'clock to 2 o'clock. Separating the high pressure pad from the low pressure pad are first and second seal lands 106, 108. The first seal land 106, therefore extends from approximately 2 o'clock to 4 o'clock, while the second seal land 108 extends from approximately 8 o'clock to 10 o'clock.

The bearing arrangement defines a combination hydrostatic and hydrodynamic configuration. The hydrostatic portion of the bearing is the two pad arrangement defined by the high pressure and low pressure pads 102, 104, respectively. The high pressure pad is a groove cut through the full width or extent of the yoke, i.e., from a front face 50*a* to a rear face 50*b*, as will be more clearly appreciated from a review of FIG. 6. Likewise, the low pressure pad is also a groove through the full width of the yoke. The high pressure pad is capable of supporting the forces generated by the internal components of the pumping mechanism. Between the two pads, in the yoke, are the seal lands 106, 108 that create a hydrodynamic effect that enables smooth start-up and centers the cam ring within the bearing during operation.

The high pressure pad geometry is determined so that the force generated by the fluid pressure is slightly greater than the forces generated by the internal pumping elements. The circumferential extent of the pad 102, i.e., from 4 o'clock to 8 o'clock, is determined by the radial thickness of the cam ring. It is preferred that the edges 102*a*, 102*b* of the high pressure pad are located outside the inside diameter 72 of the cam ring (see FIG. 5). The seals and the sides of the high pressure groove, that is along the faces 50*a*, 50*b* of the yoke, are created by the port plates 90, 92 (FIG. 3) which clamp across the pumping element. High pressure fluid (jet fuel) is fed into the pad through openings 120 shown in FIG. 6 and the flow to the interface between the yoke and the cam ring is restricted through orifices 122 (only one of which is seen in the view of FIG. 6). As will be appreciated, the high pressure orifices 122 communicate with respective openings or holes 120 in this region of the bearing assembly.

The geometry of the low pressure pad 104 is determined by setting circumferential edges 104*a*, 104*b* slightly wider than the circumferential edges of the high pressure pad, i.e., slightly wider than 102*a*, 102*b*, respectively. Venting from the high pressure pad to the low pressure pad must be provided in this pad such that high pressure does not build. This is provided through openings 124, one of which is illustrated in FIG. 6. As will be apparent, openings 124 have a substantially larger diameter than openings 122. Therefore, a differential pressure is established across the yoke to react the forces within the pumping element.

The high and low pressure pads 102, 104 are cut completely through the bearing, i.e., they extend completely from face 50*a* to 50*b*, to allow the cam ring to move in the vertical direction as depicted in FIG. 5. The movement in the vertical direction allows for radial deflection of the yoke in the horizontal direction, thus increasing the clearance between the lands and the cam ring. When the clearance increases, the flow through the bearing must increase to maintain the pressure in the high pressure pad, or the clearance must be reduced. The orifices 122 on the high pressure pad side restrict the flow and thus the cam ring moves vertically forward decreasing the clearance to re-establish an equilibrium force condition. This creates a relatively stiff bearing without the concerns of deflection.

The entire bearing, yoke 50 and cam ring 70 is free to roll within the pumping mechanism as described above. As shown in FIG. 5, the bearing rolls leftwardly or rightwardly along the generally planar surface 42 provided in the spacer ring 40. This rolling on the surface 42 acts to provide a linear translation of the cam ring. Linear cam ring translation is critical to minimizing fluid pump pressure pulsation during operation. Sliding and rotation of the yoke are prevented by the anti-rotation disks 44 inserted on each side of the yoke. As will be apparent from FIG. 6, these anti-rotation disks 44 are dimensioned for receipt in arcuate recesses or cutouts 130, only one of which is illustrated in FIG. 6, although it will be appreciated that a similar cutout recess is provided on the rear surface 50*b* of the yoke. Thus, these anti-rotation disks 44 do not pass completely through the yoke, or corresponding recesses provided in the spacer ring, and thereby allow the forces in yoke to be transmitted to the housing structure through the spacer ring.

It will also be appreciated that in the preferred embodiment of the yoke 50, an undercut 140 is provided on the first and second surfaces 50*a*, 50*b*. The undercut 140 is provided at the outer radial perimeter of these faces. Moreover, the undercut extends circumferentially around substantially the entire yoke, i.e., from approximately 6:30 in a clockwise direction to approximately 5:30. The undercut facilitates control of pressure on the face of the yoke and accurately predicts or controls the pressure of the overall pump arrangement.

The invention has been described with reference to the preferred embodiments. Obviously, modifications and alterations will occur to others upon reading and understanding the preceding detailed description. It is intended that the invention be construed as including all such modifications and alterations in so far as they come within the scope of the appended claims or the equivalents thereof.

Having thus described the invention, it is now claimed:

1. In a fuel delivery system having a housing that rotatably receives a rotor carrying vanes thereon and received within a rotatable cam ring located between the housing and the rotor and freely rotatable relative to each of the housing and rotor, the bearing assembly comprising:

a hydrostatic and hydrodynamic bearing member including an annular surface having a central opening dimensioned to receive the associated cam ring therein, the annular surface including a first, high pressure pad and a second, low pressure pad substantially diametrically opposite the first pad, and first and second lands separating the first and second pads for centering the associated cam ring during operation.

2. The bearing assembly of claim 1 wherein the circumferential extent of the first pad is at least as great as an inner diameter of the associated cam ring.

3. The bearing assembly of claim 2 wherein circumferential ends of the second pad are wider than circumferential ends of the first pad.

4. The bearing assembly of claim 1 wherein the first and second pads are formed by circumferentially extending grooves that extend an entire width of the bearing.

5. The bearing assembly of claim 1 further comprising means for preventing rotation of the bearing member.

6. The bearing assembly of claim 5 wherein the preventing means further prevents relative sliding between the cam ring and the bearing member.

7. A bearing assembly for an associated fuel delivery system having a housing that rotatably receives a rotor carrying vanes thereon, and a cam ring rotatably received between the housing and rotor, and a yoke encompassing the cam ring and selectively movable relative to the housing to vary fuel flow from the system, the bearing assembly comprising:

a hydrostatic and hydrodynamic bearing member including an annular surface having a central opening therethrough, the annular surface including a first, high pressure pad and a second, low pressure pad substantially diametrically opposite the first pad and separated by first and second lands.

8. The bearing assembly of claim 7 wherein the circumferential extent of the first pad is at least as great as an associated inner diameter of the associated cam ring.

9. The bearing assembly of claim 8 wherein circumferential ends of the second pad are wider than circumferential ends of the first pad.

10. The bearing assembly of claim 7 wherein the first and second pads are formed by circumferentially extending grooves that extend an entire width of the bearing.

11. The bearing assembly of claim 7 further comprising means for preventing rotation of the bearing member.

12. The bearing assembly of claim 11 wherein the preventing means further prevents relative sliding between the tarn ring and the bearing member.

13. The bearing assembly of claim 7 further comprising a vent passage extending through the bearing and communicating with the second, low pressure pad to prevent high pressure from building.

14. The bearing assembly of claim 13 wherein the vent passage has a cross-sectional area greater than high pressure feed orifices whereby a pressure differential is established across the yoke.

15. The bearing assembly of claim 14 wherein the cam ring moves between the first and second pads, and thereby varies a clearance between the lands and the cam ring.

16. The bearing assembly of claim 7 wherein the bearing assembly, comprised of the yoke and cam ring, is adapted for rolling movement relative to the housing whereby the cam ring undergoes selective linear translation.

17. The bearing assembly of claim 7 wherein the cam ring is adapted for linear translation relative to the housing to minimize pressure pulsations during operation of the fuel delivery system.

18. A bearing assembly for an associated fuel delivery system having a housing that rotatably receives a rotor carrying vanes thereon, and a cam ring rotatably received between the housing and rotor, and a yoke encompassing the cam ring and selectively movable relative to the housing to vary fuel flow from the system, the bearing assembly comprising:

a bearing member including an annular surface having a central opening therethrough, the annular surface including a first, high pressure pad and a second, low pressure pad substantially diametrically opposite the first pad and separated by first and second lands; and further comprising a vent passage extending through the bearing and communicating with the second, low pressure pad to prevent high pressure from building.

19. The bearing assembly of claim 18 wherein the vent passage has a cross-sectional area greater than high pressure feed orifices whereby a pressure differential is established across the yoke.

20. The bearing assembly of claim 19 wherein the cam ring moves between the first and second pads, and thereby varies a clearance between the lands and the cam ring.

* * * * *